US007794313B2

(12) United States Patent
Ruberg

(10) Patent No.: US 7,794,313 B2
(45) Date of Patent: Sep. 14, 2010

(54) AIR REGISTER COVER ASSEMBLY

(76) Inventor: Daniel C. Ruberg, 3000 Gulfshore Blvd., North Unit 111, Naples, FL (US) 34104

( * ) Notice: Subject to any disclaimer, the term of this patent is extended or adjusted under 35 U.S.C. 154(b) by 1215 days.

(21) Appl. No.: 11/203,880

(22) Filed: Aug. 15, 2005

(65) Prior Publication Data

US 2007/0037508 A1 Feb. 15, 2007

(51) Int. Cl.
*F24F 13/06* (2006.01)
*F24F 13/08* (2006.01)
*F24F 13/00* (2006.01)

(52) U.S. Cl. ..... 454/307; 454/284; 454/306; D23/387; D23/388

(58) Field of Classification Search ..... 454/270, 454/284, 289, 325, 370, 306, 307; D23/387, D23/388

See application file for complete search history.

(56) References Cited

U.S. PATENT DOCUMENTS

| | | | | | |
|---|---|---|---|---|---|
| 450,322 | A | * | 4/1891 | Segal | 55/505 |
| 562,530 | A | * | 6/1896 | Hanson | 454/289 |
| D49,102 | S | * | 5/1916 | Triggs | D23/388 |
| D52,086 | S | * | 6/1918 | Triggs | D23/388 |
| 1,488,694 | A | * | 4/1924 | Marks | 55/414 |
| D104,763 | S | * | 6/1937 | Black | D23/388 |
| 3,064,550 | A | * | 11/1962 | O'Day et al. | 454/301 |
| 3,673,770 | A | | 7/1972 | Novak | |
| D225,011 | S | * | 10/1972 | Steiner | D23/411 |
| 4,182,227 | A | * | 1/1980 | Roy | 454/302 |
| 4,520,715 | A | | 6/1985 | Coomes et al. | |
| 5,525,145 | A | | 6/1996 | Hodge | |
| D382,049 | S | * | 8/1997 | Trampp | D23/365 |
| 5,716,270 | A | * | 2/1998 | Chambers | 454/332 |
| 5,720,660 | A | | 2/1998 | Benedetto et al. | |
| 5,984,776 | A | | 11/1999 | Berger | |
| 6,047,662 | A | | 4/2000 | Fekete | |
| D452,904 | S | | 1/2002 | Peng | |
| 6,575,827 | B1 | * | 6/2003 | Rutler et al. | 454/289 |
| 6,814,660 | B1 | | 11/2004 | Cavett | |
| 2005/0064806 | A1 | * | 3/2005 | Issod | 454/12 |

FOREIGN PATENT DOCUMENTS

DE 3139997 A1 * 3/1983

* cited by examiner

*Primary Examiner*—Steven B McAllister
*Assistant Examiner*—Patrick F. O'Reilly, III

(57) ABSTRACT

An air register cover assembly (1) comprising a front panel (2) having a face and rear portion (18) and (19), at least one spacer (4) located on the rear portion (19) and a means for hanging the front panel (2) in front of an air duct (21). An alternate embodiment may include an air register housing (5) which is fitted within an air duct. The housing (5) includes housing openings (7) to permit air from an air duct (21) to be expelled. The front panel (2) may include an insulated backing (8) having spacers (4) attached thereto. When in use, the air register cover assembly (1) re-directs the air flow so as to be expelled around the front panel (2), rather than directly into a room. The use of the present invention not only circulates air within a room, but it also makes air registers more attractive.

11 Claims, 3 Drawing Sheets

AIR REGISTER COVER ASSEMBLY

BACKGROUND OF THE INVENTION

This invention relates to air registers, more particularly, an air register cover assembly that provides better air circulation within a room as compared to conventional air registers.

Conventional air registers are inserted into air ducts and include metal slats that are adjustable so as to direct the flow of air in a certain direction. While conventional air registers do serve the purpose of cooling or heating a room, there are many drawbacks to using such air registers. For instance, many individuals find that certain areas of a room are colder or warmer than others due to the direction the slats are facing. Moreover, many individuals find themselves uncomfortable temperature-wise as the direct flow of air onto a person can make that person too cold or too hot.

Additionally, dust, dirt and other debris which is exhausted through the air duct collects on the slats of the air register. When the air conditioner or heater turns on, some of the dust, dirt and debris is then blown off the air register slats and out into the room. If the slats are directed towards a place where a person is sitting or standing, the dust, dirt and debris is essentially blown onto the person, causing not only physical discomfort but also sickness.

Finally, as conventional air registers typically include metal slats, many individuals find the air registers unattractive. Although the air registers may be painted so as to match the wall or ceiling color of a room, dust, dirt and other debris collects onto the slats and makes the air register even more unattractive.

Thus, a need exists for an air register cover assembly that permits air flow from an air duct to cool or heat a room while preventing direct air flow onto individuals sitting or standing in a room.

| | | |
|---|---|---|
| 5,525,145 | Hodge | Jun. 11, 1996 |
| 4,520,715 | Coomes et al. | Jun. 04, 1985 |
| 5,984,776 | Berger | Nov. 16, 1999 |
| 5,720,660 | Benedettto et al. | Feb. 24, 1998 |
| 6,814,660 | Cavett | Nov. 09, 2004 |
| D452,904 | Peng | Jan. 08, 2002 |
| 6,047,662 | Fekete | Apr. 11, 2000 |
| 3,673,770 | Novak | Jul. 04, 1972 |

SUMMARY OF THE INVENTION

The primary object of the present invention is to provide an air register cover assembly that permits the flow of air from an air duct while preventing direct air flow onto individuals in a room.

A further object of the present invention is to provide an air register cover assembly that is attractive.

An even further object of the present invention is to provide an air register cover assembly that limits the amount of dust, dirt and debris that is blown into a room.

Another object of the present invention is to provide an air register cover assembly that is insertable into air ducts.

A further object of the present invention is to provide an air register cover assembly that has a changeable face to suit a person's decor preference.

The present invention fulfills the above and other objects by providing an air register cover assembly for an air duct comprising a front panel having a face portion and a rear portion, at least one spacer located on the rear portion of the front panel and a means for hanging the front panel in front of an air duct. When in use, the air register cover assembly changes the direction of air flow from directly out of an air register to flowing from the sides of the air register cover assembly.

An alternate embodiment of the present invention fulfills the above and other objects by providing an air register cover assembly comprising a front panel having a face portion and a rear portion, at least one spacer located on the rear portion of the front panel and a housing having first and second horizontal walls and first and second vertical walls secured to the front panel. The walls are secured together so as to form a square/rectangle. When the walls are secured, an opening for access to an air duct is created. At least one of the walls has an opening for air from the air duct to escape. The air register cover assembly is then secured to the air register by a fastening means. Similar to the embodiment noted above, the air flow direction is changed so as flow around the front panel.

Yet another alternate embodiment of the present invention fulfills the above and other objects by providing an air register cover assembly comprising a front panel having a face portion and a rear portion and a spacer located on the rear portion of the front panel. The spacer, which is a mesh screen, runs along the rear portion and has a plurality of apertures so as to allow air flow to travel through the spacer. Similar to the embodiments noted above, the air flow direction is changed so as to flow around the front panel.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
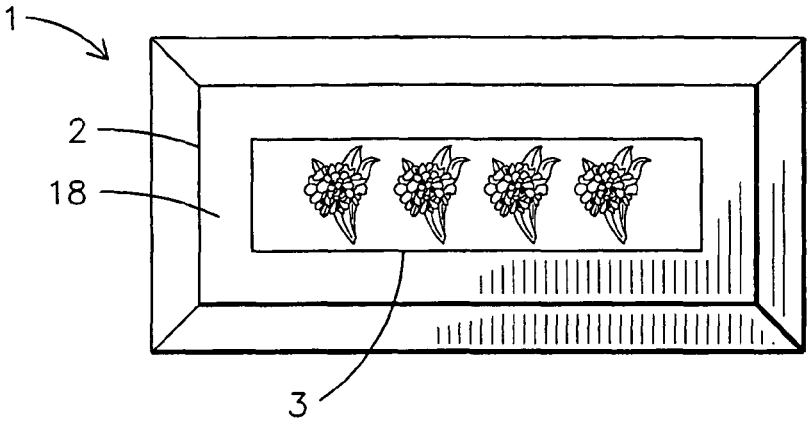
FIG. 1 is a front view of a first embodiment of the present invention.

For purposes of describing the preferred embodiment, the terminology used in reference to the numbered components in the drawings is as follows:

| | |
|---|---|
| 1. | air register cover assembly, generally |
| 2. | front panel |
| 3. | decorative element |
| 4. | spacer |
| 5. | air register housing |
| 6. | access to air duct |
| 7. | housing opening |
| 8. | backing |
| 9. | means for hanging |
| 10. | filter |
| 11. | bars |
| 12. | horizontal wall |
| 13. | vertical wall |
| 14. | left edge |
| 15. | right edge |
| 16. | top edge |
| 17. | bottom edge |
| 18. | front panel face portion |
| 19. | front panel rear portion |
| 20. | building wall |
| 21. | air duct |
| 22. | air flow from air duct |
| 23. | spring-loaded clips |
| 24. | mesh screen |

With reference to FIG. 1, a front view of a first embodiment of the present invention is shown. The air register cover assembly, generally 1 includes a front panel 2 having a front panel face portion 18. A decorative element 3 may be located on the front panel face portion 18. The decorative element 3 may be a photograph, picture, drawing or any other item that is attractive to a person. In addition, the decorative element 3 may be changed by a user so as to correspond with holidays, seasons, decor or simply a person's decorating preference. The decorative element 3 may be framed so as to give a more aesthetically pleasing appearance.

Figure 2:
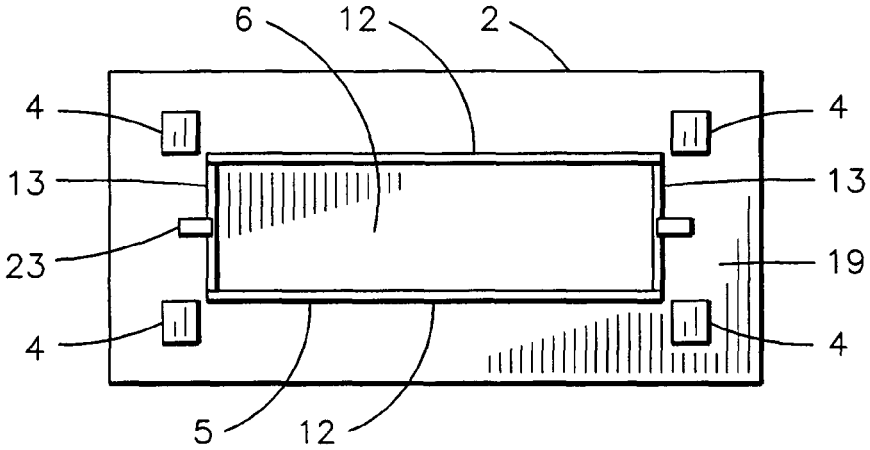
FIG. 2 is a rear view of a first embodiment of the present invention.

In FIG. 2, a rear view of a first embodiment of the present invention is shown. The front panel 2 includes a front panel rear portion 19 having a predetermined perimeter. As illustrated, an air register housing 5, preferably having two horizontal walls 12 and two vertical walls 13, is secured to the front panel rear portion 19. The walls 12 and 13 of the housing 5 are secured to one another so as to form a square/rectangle shape having an access to an air duct 6. Spacers 4, which may be rods, blocks or any other similar items which provide space between items, are secured to the front panel rear portion 19.

Figure 3:
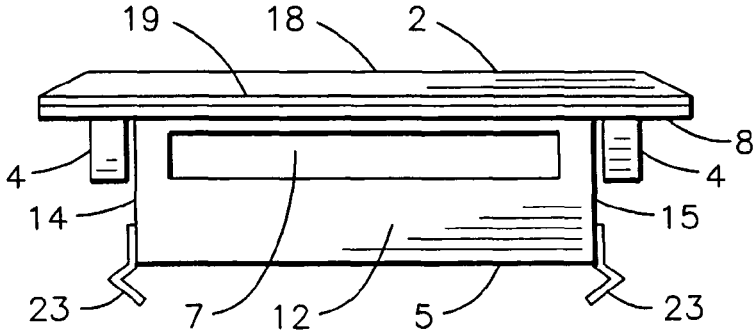
FIG. 3 is a top view of a second embodiment of the present invention.
Figure 4:
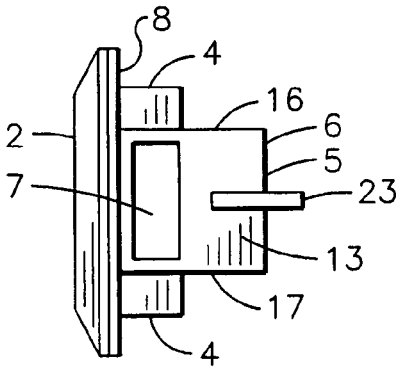
FIG. 4 is a side view of a second embodiment of the present invention.

FIGS. 3 and 4 show varying views of a second embodiment of the present invention with a backing 8 secured to the front panel rear portion 19. The backing 8 is preferably made of an aluminum insulating material so as to prevent overheating of the cooling/heating unit and the front panel 2. The horizontal walls 12 each have a left edge 14 and a right edge 15 while the vertical walls 13 each have a top edge 16 and a bottom edge 17. Housing openings 7 are located on each of the walls 12 and 13 so as to permit air from the air duct to flow from the air duct, through the access to air duct 6 and out through the housing openings 7. The spacers 4 create a space between the front panel 2 and the housing 5 such that the housing openings 7 are exposed when the air register cover assembly 1 is inserted into an air duct. Optional spring-loaded clips 23 may be secured to the housing 5 as a means for securing the cover assembly 1 in an air duct.

Figure 5:
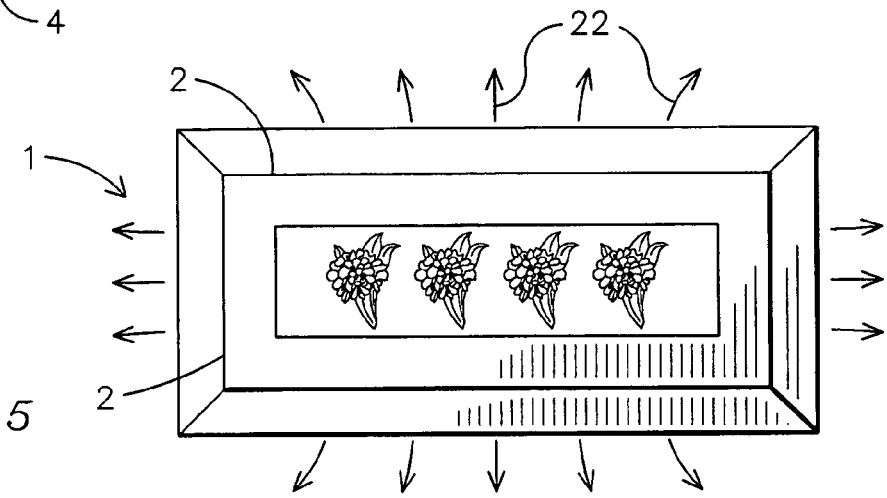
FIG. 5 is a front view of a second embodiment of the present invention showing the circulation of air when the present invention is installed in an air duct.

FIG. 5 shows the circulation of air when the air register cover assembly 1 of the present invention is installed in an air duct. Rather than the air blowing directly from a front of an air register into a room, as in conventional air registers, air flows from sides of the air register cover assembly 1 around the front panel 2 as indicated by air flow arrows 22.

Figure 6:
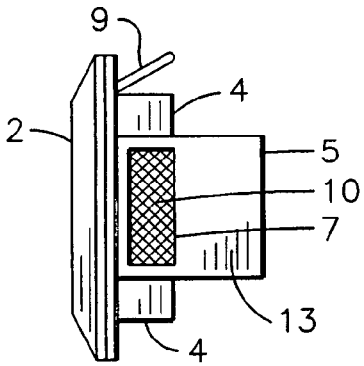
FIG. 6 is a side view of a third embodiment of the present invention.

With reference to FIG. 6, a side view of a third embodiment of the present invention is shown. In this embodiment, the housing openings 7 are covered with a filter 10 so as to limit the amount of dust, dirt and debris that is expelled through the air duct.

Figure 7:
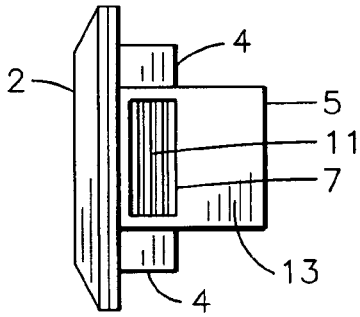
FIG. 7 is a side view of a fourth embodiment of the present invention.

In FIG. 7, a side view of a fourth embodiment of the present invention is shown wherein the housing openings 7 are covered with bars 11 so as to limit the amount of dust, dirt and debris that is expelled through the air duct.

Figure 8:
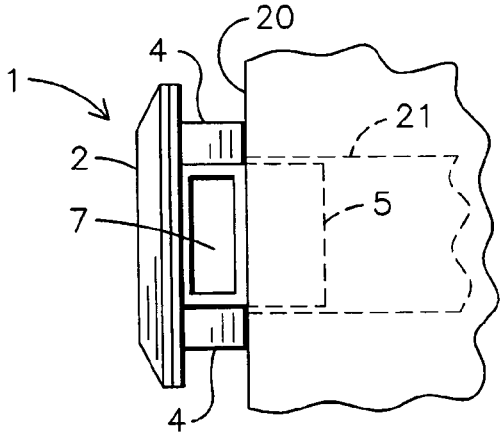
FIG. 8 is a side plan view of a second embodiment of the present invention installed in an air duct.

FIG. 8 shows a side plan view of a second embodiment of an air register cover assembly 1 of the present invention installed in an air duct 21. The spacers 4 keep the front panel 2 at a predetermined distance away from a building wall 20, thereby allowing the housing openings 7 to be exposed. The remaining portion of the housing 5 is inserted into an air duct 21 and is secured by a fastening means. The fastening means may include a pressure-fitted means wherein a person need only press the housing 5 into the air duct for securement, using screws, bolts or the like or other similar fastening means.

Figure 9:
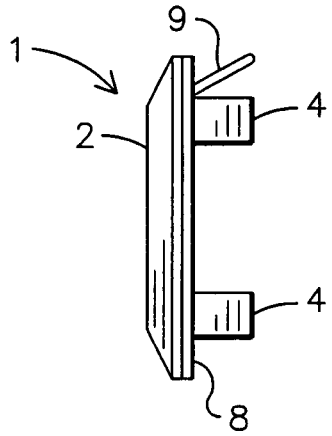
FIG. 9 is a side view of a fifth embodiment of the present invention.

FIG. 9 shows a side view of a fifth embodiment of the air register cover assembly 1 of the present invention. In this manner, the air register cover assembly 1 simply hangs over an existing air register and air duct, thereby altering the flow of air from the air duct and air register.

Figure 10:
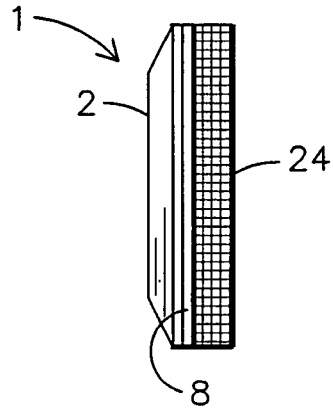
FIG. 10 is a side view of a sixth embodiment of the present invention.

With reference to FIG. 10, a side view of a sixth embodiment of the air register cover assembly 1 of the present invention is shown. The mesh screen 24 also acts as a spacer 4 and preferably follows the shape of the backing 8 or, if a backing 8 is not used, the perimeter of the rear portion of the front panel 19. The mesh screen 24 includes a plurality of apertures and preferably has rounded edges for safety. In this embodiment, the mesh screen 24 not only keeps the cover assembly 1 a predetermined distance away from a conventional air register, but it also permits air to flow from the air duct, out the conventional register and around the front panel 2.

Figure 11:
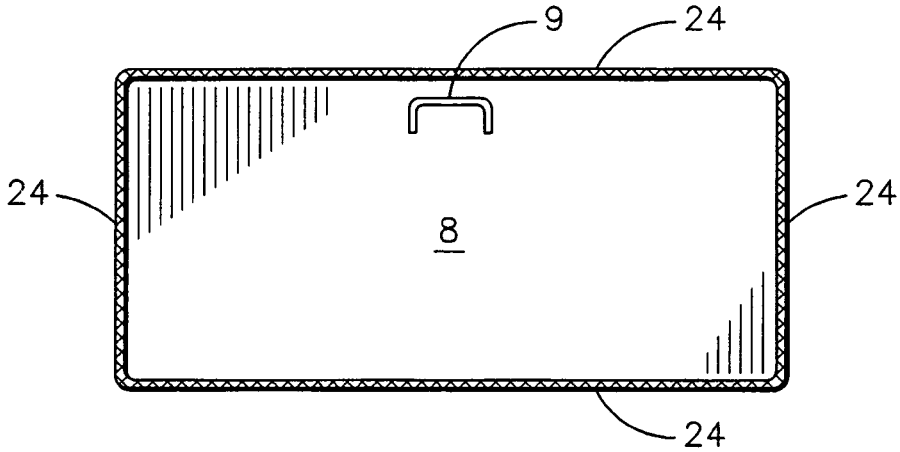
FIG. 11 is a rear view of a sixth embodiment of the present invention.

In FIG. 11, a rear view of a sixth embodiment of the present invention is shown wherein a means for hanging 9 is attached to the backing 8. The means for hanging 9 may be hooks, similar to those found on picture frames.

Figure 12:
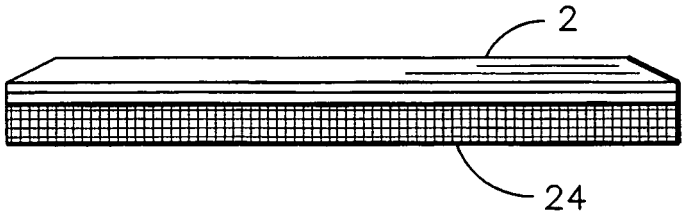
FIG. 12 is a top view of a sixth embodiment of the present invention.

Finally, FIG. 12 shows a top view of a sixth embodiment of the present invention. The mesh screen 24 follows the shape of the backing 8, or front panel rear portion 19 if a backing 8 is not used, so as to keep the cover assembly 1 away from a conventional air register.

The use of the present invention will allow a person to use an air duct cover assembly that permits the flow of air from an air duct that is attractive and decorative while preventing direct air flow onto individuals in a room.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. An air register cover assembly for an air duct comprising:

an imperforate front panel portion having a face portion and a rear portion;

said rear portion comprising an aluminum backing layer that is configured to prevent the overheating of said front panel portion, said aluminum backing layer being substantially flat;

at least one spacer secured to said rear portion of said front panel portion, said at least one spacer having a predetermined length measured from said rear portion of said front panel portion to a distal end of said at least one spacer, the distal end of said at least one spacer being configured to be placed against a building wall;

a housing having a first and second horizontal wall;

said first and second horizontal walls each having a left and right edge;

said housing having a first and second vertical wall;

said first and second vertical walls each having a top and bottom edge;

said first and second horizontal walls and said first and second vertical walls each having a predetermined length measured from said rear portion of said front panel portion to a distal end of each of said horizontal and vertical walls, said distal end of each of said horizontal and vertical walls being configured to be inserted into an air duct opening;

said front panel portion having an overhanging peripheral edge portion which extends a predetermined distance beyond an outer surface of each of said horizontal and vertical walls;

said first horizontal left edge being attached to said first vertical wall top edge at a substantially ninety degree angle;

said first horizontal wall right edge being attached to said second vertical wall top edge at a substantially ninety degree angle;

said second horizontal wall left edge being attached to said first vertical wall bottom edge at a substantially ninety degree angle;

said second horizontal wall right edge being attached to said second vertical wall bottom edge at a substantially ninety degree angle to form a rear opening for access to said air duct opening;

said rear portion of said front panel portion being secured to said housing substantially parallel to said rear opening;

at least one wall opening in at least one of said horizontal and vertical walls of said housing; and a means for securing said housing to said air duct;

wherein said at least one spacer is disposed on said overhanging peripheral edge portion of said front panel portion; and wherein said predetermined length of each said horizontal and vertical walls is at least two times greater than said predetermined length of said at least one spacer.

2. The air register cover air assembly for an air duct of claim 1 wherein said aluminum backing layer is secured to a front panel layer of said front panel portion.

3. The air register cover assembly for an air duct of claim 2 wherein a decorative element is located on said face portion of said front panel portion.

4. The air register cover assembly for an duct of claim 2 wherein said at least one wall opening in said at least one of said horizontal and vertical walls of said housing is covered with a filter.

5. The air register cover assembly for an air duct of claim 1 wherein a decorative element is located on said face portion of said front panel portion.

6. The air register cover assembly for an air duct of claim 1 wherein said means for securing said housing to said air duct is by pressure-fitting said housing within said air duct opening.

7. The air register cover assembly for an air duct of claim 1 wherein said means for securing said housing to said air duct is by clips.

8. The air register cover assembly for an duct of claim 1 wherein said at least one wall opening in said at least one of said horizontal and vertical walls of said housing is covered with a filter.

9. The air register cover assembly for an air duct of claim 1 wherein said at least one wall opening in said at least one of said horizontal and vertical walls of said housing has at least one bar.

10. The air register cover assembly for an air duct of claim 1 wherein a means for hanging said air register cover assembly is located on said rear portion of said front panel portion.

11. An air register cover assembly for an air duct comprising:

an imperforate front panel portion having a face portion and a rear portion;

a housing having a first and second horizontal wall;

said first and second horizontal walls having left and right edges;

said housing having a first and second vertical wall;

said first and second vertical walls each having a top and bottom edge;

said first and second horizontal walls and said first and second vertical walls each having a predetermined length measured from said rear portion of said front panel portion to a distal end of each of said horizontal and vertical walls, said distal end of each of said horizontal and vertical walls being configured to be inserted into an opening of an air duct;

said first horizontal wall left edge being attached to said first vertical wall top edge at a substantially ninety degree angle;

said first horizontal wall right edge being attached to said second vertical wall top edge at a substantially ninety degree angle;

said second horizontal wall left edge being attached to said first vertical wall bottom edge at a substantially ninety degree angle;

said second horizontal wall right edge being attached to said second vertical wall bottom edge at a substantially ninety degree angle;

a rear opening for access to said air duct;

a first wall opening in said first horizontal wall;

a second wall opening in said second horizontal wall;

a third wall opening in said first vertical wall;

a fourth wall opening in said second vertical wall;

said rear portion of said front panel portion being secured to said housing, wherein said front panel portion is substantially parallel to said rear opening;

said front panel portion having an overhanging peripheral edge portion which extends a predetermined distance beyond an outer surface of each of said horizontal and vertical walls;

said rear portion of said front panel portion comprising a backing, said backing including an aluminum layer to prevent an overheating of said front panel portion, said aluminum layer being substantially flat;

at least one spacer secured to said backing of said rear portion of said front panel portion, said at least one spacer having a predetermined length measured from said rear portion of said front panel portion to a distal end of said at least one spacer, the distal end of said at least one spacer being configured to be placed against a building wall;

a decorative element located on said front panel portion; and a means for securing said housing in said air duct, wherein said means for securing said housing in said air duct is by pressure-fitting said housing within said air duct;

wherein said at least one spacer is disposed on said overhanging peripheral edge portion of said front panel portion; and wherein said predetermined length of each said horizontal and vertical walls is at least two times greater than said predetermined length of said at least one spacer.

* * * * *